US006559606B1

(12) United States Patent
Chou et al.

(10) Patent No.: US 6,559,606 B1
(45) Date of Patent: May 6, 2003

(54) LAMP DRIVING TOPOLOGY

(75) Inventors: John Chou, Monterey Park, CA (US); Arnel Dela Cruz, Santa Clara, CA (US)

(73) Assignee: O2Micro International Limited, Grand Cayman (KN)

( * ) Notice: Subject to any disclaimer, the term of this patent is extended or adjusted under 35 U.S.C. 154(b) by 0 days.

(21) Appl. No.: 10/035,973

(22) Filed: Oct. 23, 2001

(51) Int. Cl.[7] ..... H05B 41/38
(52) U.S. Cl. ..... 315/194; 315/195
(58) Field of Search ..... 315/194, 291, 315/244, 209 R, 195, 199, 201, 294

(56) References Cited

U.S. PATENT DOCUMENTS 3,878,431 A * 4/1975 Petrina ..... 315/195
6,222,327 B1 * 4/2001 Shoji et al. ..... 315/291

* cited by examiner

*Primary Examiner*—James Clinger
(74) *Attorney, Agent, or Firm*—Grossman, Tucker, Perreault & Pfleger, PLLC

(57) ABSTRACT

A lamp driving system that includes a first impedance and a second impedance coupled to the secondary side of a transformer, where the second impedance has a phase shifted value compared to the first impedance. Two lamp loads are connected in series together, and in parallel to the first and second impedances and to the transformer. The phase shift between the impedances ensures that the transformer need not supply double the striking voltage to strike the series-connected lamps. A difference in the resistance between the first and second impedances ensures that the lamps ignite in a specified sequence.

34 Claims, 2 Drawing Sheets

LAMP DRIVING TOPOLOGY

BACKGROUND OF THE INVENTION

1. Field of the Invention

The present invention relates to a system and method for driving multiple loads. More particularly, the present invention relates to a system and method for driving two lamp loads connected in series.

2. Description of Related Art

CCFLs (cold cathode fluorescent lamps) are widely employed in display panels. CCFLs require approximately 1500 Volts (RMS) to strike, and require approximately 800 Volts (RMS) for steady state operation. In displays where two CCFLs are required, a conventional technique is to couple the lamps in parallel with the secondary side of step-up transformer. In multiple lamp systems, the conventional technique for driving the lamps is to couple the lamps together in parallel with one another to the transformer. While this ensures voltage control during striking, this topology also requires impedance matching circuitry for the lamps. Also, current control in this topology is difficult since the current conditions of each lamp must be monitored.

Accordingly, it is desirable to couple lamps in series since current control for series-connected lamps is idealized. However, connecting lamps in series requires the transformer to deliver a multiple of striking voltage for each lamp. This, obviously is untenable since most transformers are incapable of providing 3000 Vrms for striking, or are prohibitively expensive. Thus, there is a need to provide a lamp driving system that can drive two lamps coupled in series without straining the transformer to develop double the striking voltage.

SUMMARY OF THE INVENTION

Accordingly, the present invention provides a load driving system, comprising a transformer; a first impedance network coupled in series to a second impedance network, said second impedance network being phase-shifted with respect to the first impedance network, the first and second impedance networks coupled in parallel to a power source. A first load is coupled in series to a second load, the first and second loads are coupled in parallel to said first and second impedance networks.

In another embodiment, the present invention provides a circuit, comprising a first impedance network coupled in series to a second impedance network, said second impedance network being phase-shifted with respect to said first impedance network, said first and second impedance networks coupled in parallel to a power source; and a first load coupled in series to a second load, said first and second loads coupled in parallel to said first and second impedance networks.

In the present invention, the phase difference between the first and second impedance networks ensures that the power source deliver significantly less voltage the loads connected in series. Also, in other exemplary embodiments, the resistance difference between the first and second impedances ensures a desired load striking sequence.

It will be appreciated by those skilled in the art that although the following Detailed Description will proceed with reference being made to preferred embodiments, the present invention is not intended to be limited to these preferred embodiments. Other features and advantages of the present invention will become apparent as the following Detailed Description proceeds, and upon reference to the Drawings, wherein like numerals depict like parts, and wherein:

DETAILED DESCRIPTION OF EXEMPLARY EMBODIMENTS

Figure 1:
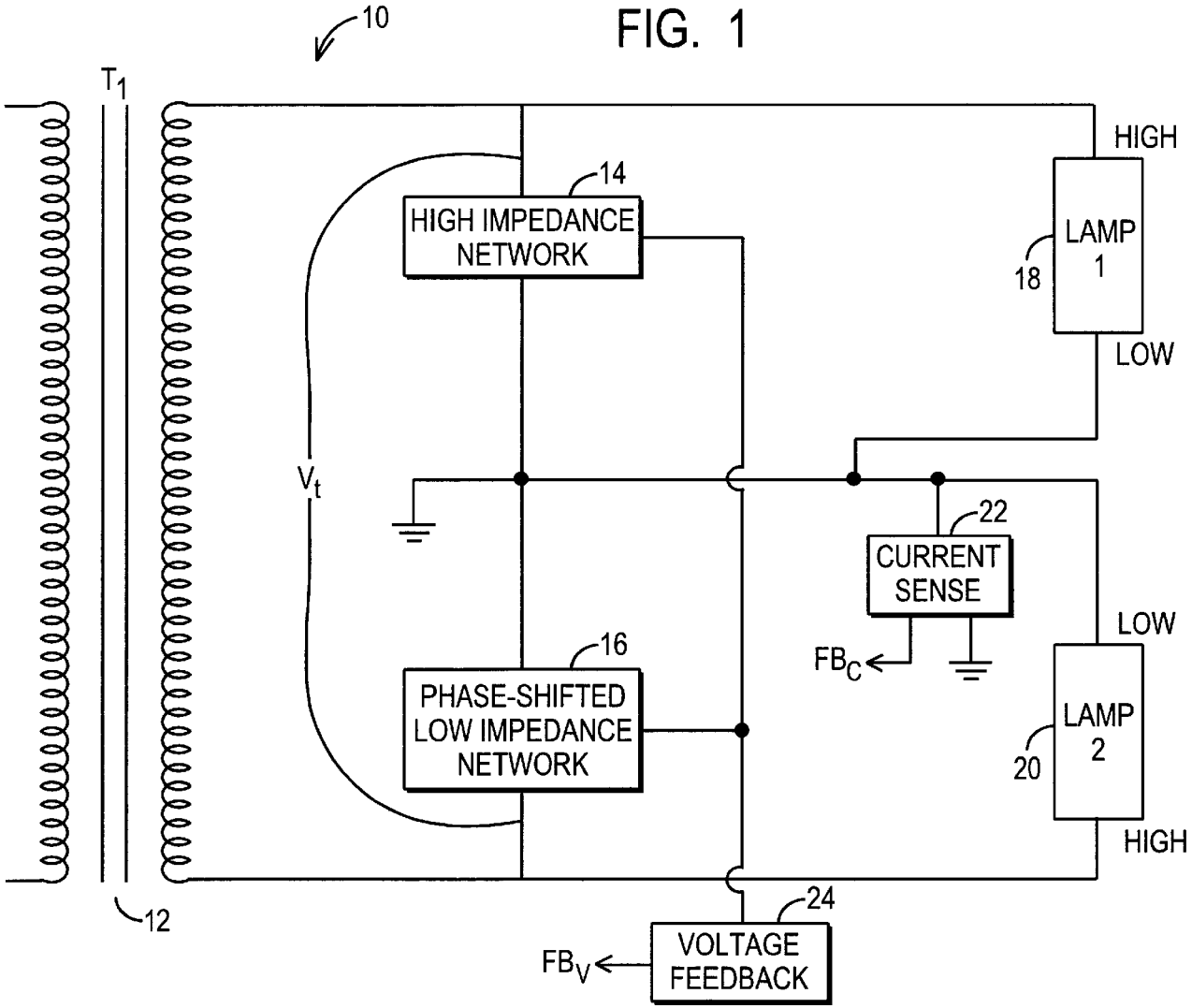
FIG. 1 is a block diagram of one exemplary lamp driving system according to the present invention.

FIG. 1. is a block diagram of one exemplary load driving system 10 according to the present invention. More specifically, the system 10 is an exemplary lamp driving system. The loads in this exemplary embodiment comprise two lamps, Lamp1 and Lamp2, connected in series, however the present invention is to be broadly construed to cover any particular load. The transformer 12 delivers a stepped-up power source for the loads, Lamp1 and Lamp2. In the following description, the transformer will be generically referred as a power source, and should be broadly construed as such. Those skilled in the art will recognize that conventional inverter topologies may be used to drive the primary side of the transformer 12. Such inverter topologies include push-pull, Royer, half bridge, full bridge, etc., and all such inverters may be used with the lamp driving system 10 of the present invention. As an overview, the system 10 depicted herein permits two lamps to be connected in series without requiring double the voltage output of the secondary side of the transformer. The exemplary embodiments will be described herein with reference to cold cathode fluorescent lamps (CCFLs), however the present invention is applicable to any type of load.

The system 10 includes a high impedance network 14 coupled in series to a phase-shifted low impedance network 16. These two networks together are coupled in parallel to the secondary side of the transformer 12. Two lamps 18 and 20 (also referred to herein as Lamp1 and Lamp2) are coupled in series to each other, and together in parallel across the impedance networks 14 and 16. Lamp1 is connected in parallel across the high impedance network 14 (with a return path across the low impedance network 16 as will be described below) and Lamp2 is connected in parallel across the phase-shifted low impedance network 16. Note that the "High" side of Lamp1 is connected to the upper side of the transformer 12, and Lamp2 has the "High" side connected to the lower side of the transformer 12. Voltage feedback circuitry 24 is coupled to the high impedance network 14 and the phase-shifted low impedance network 16 to generate a voltage feedback signal $FB_V$ indicative of the voltage appearing on Lamp1 or Lamp2. The voltage feedback circuitry may comprise a peak detector or other type of circuitry as is known in the art. Current sense circuitry 22 is coupled to the Low side of Lamp2 to generate a current feedback signal $FB_C$ indicative of power being delivered to Lamp2. The voltage and current feedback signals are generally utilized by the inverter (not shown) to adjust the voltage and power delivered by the transformer, as is understood in the art. The specific utilization of voltage and current feedback information for the present invention will be detailed below.

The present invention employs a high impedance network 14 and a low impedance network 16. Additionally, network 16 is phase shifted with respect to network 14. The network 14 comprises real components (resistance), and the network 16 is comprised of real and reactive components, or purely reactive components, provided that there exists an overall phase difference between network 16 and network 14. Since network 16 is phase shifted with respect to network 14, the total voltage ($V_t$) developed across the combined network 14 and network 16 is given by the equation:

$$V_t=\sqrt{(x^2+y^2)}; \quad \text{Eq. 1}$$

where x is the voltage developed across the (real) high impedance network and y is the voltage developed across the phased (reactive) impedance network.

Lamp Striking and Operational Sequence

The operational characteristics of the lamp driving system 10 are described below. CCFLs require approximately 1500 Vrms for striking, and then approximately 800 Vrms for operating voltage. Initially, a striking voltage is applied to the secondary side of the transformer 12. The high impedance network 14 receives a majority of this voltage because the resistance of network 14 is greater than the resistance of network 16. Since two voltage drops are present (across network 14 and network 16), the transformer delivers a voltage equal to the striking voltage of Lamp1, plus the voltage lost in network 16. This voltage is dictated by the equation set forth above for $V_t$. Lamp2 does not have a return path until Lamp1 strikes because the high impedance of Lamp1 (before struck) and the high impedance of network 14 (compared to network 16) which isolates Lamp2. Thus, Lamp1 strikes first. Network 16 provides a return path for Lamp1.

The voltage required to strike Lamp2 is approximately equal to the voltage to strike Lamp1, e.g., 1500 Vrms. Since Lamp1 is already struck, there is an operational voltage of approximately 800 Vrms across the network 14. Accordingly the controller needs to supply an additional striking voltage for Lamp2. This striking voltage is the voltage across networks 14 and 16, i.e., the voltage is $(1500^2+800^2)$, or approximately 1700V. The numerical examples provided above assume a purely reactive load in the phased low impedance network 16. Thus, instead of needing to supply 3000 Vrms to strike lamps connected in series, the system 10 of the present invention significantly reduces the voltage requirements of the transformer and system components.

The impedance difference between network 14 and network 16 ensures a desired striking sequence. In the exemplary system 10 described above, Lamp1 strikes first, with a return path through network 16. Thus, as a general statement, the impedance value of network 16 is selected to ensure a return path for Lamp1. The impedance value is also a function of operating frequency, and thus may be changed according to the frequency characteristics of the system 10. To ensure a striking sequence between Lamp1 and Lamp2, qualitatively the resistance values of the two networks is selected such that network 14 initially receives a majority of the voltage delivered by the transformer. The larger the majority (i.e., the larger the resistance values between networks 14 and 16) means the less voltage that must be developed by the transformer initially. The phase difference between network 14 and network 16 permits the present invention to utilize Eq. 1 to operate two lamps connected in series without requiring double the voltage output from the transformer.

Best Mode Implementation

Figure 2:
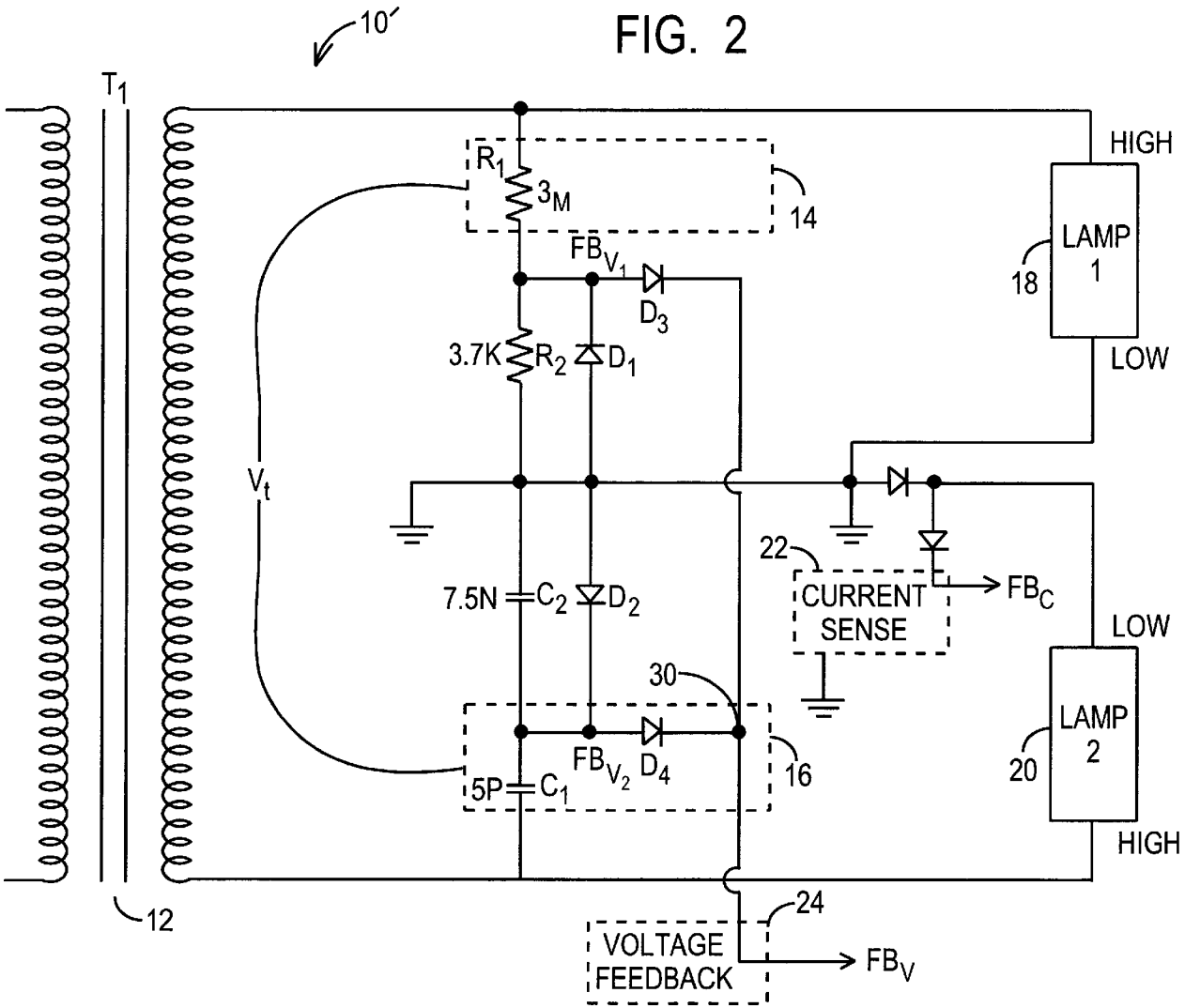
FIG. 2 is an exemplary circuit diagram of the system of FIG. 1.

FIG. 2 is an exemplary circuit diagram 10' of the lamp driving system 10 of FIG. 1. Certain component values are set forth below, however, these component values are merely exemplary and may be changed according to the principles set forth herein without departing from the scope of the present invention. The high impedance network 14 comprises a resistor R1. Resistor R2 is provided for voltage feedback data indication of voltage feedback across Lamp1. R1>>R2, so that a negligible voltage drop appears across R2. The phase shifted low impedance network comprises capacitor C1. The impedance value of the capacitor C1 (given by $\frac{1}{2}\pi fC$) is chosen in accordance with the principles set forth above, and in the example of FIG. 2 is approximately 600 kΩ (assuming a 5 pF. capacitor operating at 50 KHz). In other words, the resistance of the high impedance network is approximately 5 times greater than the impedance of the low impedance network. Capacitor C2 is provided to generate a voltage feedback signal indicative of voltage in Lamp2, and the value of C2 is larger than C1 so that a complete path for Lamp1 is provided through C1 (and through diode D2), rather than a short to ground through C2. In the figure, C2 is approximately an order of magnitude larger than C1. D1 and D2 operate as blocking diodes for the negative half cycles for the AC voltage appearing across R2 and C2, respectively.

The operation of the system 10' is set forth in the above-description of the system 10 in broad terms. Specific operation of system 10', by inspection, is as follows. Network 16 is phase-shifted 90 degrees from network 14, thereby reducing the total voltage required by the transformer. Before any lamp is struck, the secondary side of the transformer 12 develops a voltage across network 14 and 16 equal to $V_t=\sqrt{(X^2+y^2)}$; where x is the voltage developed across R1 and y is the voltage developed across C1. X also represents the voltage required to strike Lamp1, i.e., 1500 Vrms. Since the resistance of R1 is approximately 5 times greater than the resistance of C1, y is approximately 300 Vrms, yielding a total voltage of approximately 1530 Vrms. Lamp1 has sufficient voltage to strike, and is provided a return path to the transformer 12 through C1. Once struck, Lamp1 only requires approximately 800 volts. However, Lamp2 still requires 1500 Vrms to strike. Since 800Vrms is already appearing across Lamp1 and R1, the inverter is controlled (via voltage feedback circuit 24) to deliver 1500 Vrms to the secondary side of the transformer to Lamp2 for striking. However, because of the phase difference between networks 14 and 16, the transformer need only deliver a total of approximately 1700 Vrms. This again is dictated by the equation: $V_t=\sqrt{(x^2+y^2)}$; where x is the voltage developed across R1 (800 Vrms) and y is the developed across C1 which represents the voltage necessary to strike Lamp2 (1500 Vrms). Also, since Lamp1 is already struck, its intrinsic impedance reduces significantly compared with R1, and thus a return path for Lamp2 to the top side of the transformer is provided through Lamp1.

As shown in FIG. 2, there are two voltage feedback components that generate the voltage feedback signal: a first voltage feedback signal generated by network 14 ($FBV_1$) and a second voltage feedback signal generated by network 16 ($FBV_2$). More specifically, $FBV_1$ is taken from the anode of diode D3, as generated across R2, and $FBV_2$ is taken from the anode of D4, as generated across C2. Both signals combine at node 30. This configuration ensures that the larger signal of either $FBV_1$ or $FBV_2$ dominates the sensed voltage of the voltage feedback block 24. Before Lamp1 strikes, $FBV_1$ is larger than $FBV_2$, and thus the transformer voltage is controlled by $FBV_1$. After Lamp1 strikes, $FBV_1$ drops since Lamp1 requires less operating voltage. The voltage appearing on network 16 increases (because Lamp2 has not yet struck), and thus voltage is controlled by $FBV_2$ until Lamp2 strikes. Accordingly, output voltage of the transformer is controlled by $FBV_1$ or $FBV_2$. As is recognized to one skilled in the art, controlling transformer output voltage directly is difficult because the transformer 12 exists in a floating state. However, in the present invention the relative voltage drops across networks 14 and 16 are known, and it is further known that the transformer voltage is approximately equal to the striking voltage of either Lamp1 or Lamp2, as given by Eq. 1. After both lamps are turned on (struck), the output voltage of the transformer is lower than the striking voltage and the inverter controls lamp current via current feedback through Lamp2.

The present invention assumes the inverter connected to the primary of the transformer is capable of adjusting power delivered to the transformer based on the current and voltage feedback information, via an inverter controller. Such inverter controllers are well-known in the art, and generally use the feedback information to adjust a pulse width modulation switching scheme, such as provided by push-pull, Royer, half bridge and full bridge inverter topologies. Additionally, while the present invention makes specific reference to CCFLs, the present invention is equally applicable for driving many types of lamps and tubes known in the art, such as: metal halide lamps, sodium vapor lamps, and/or x-ray tubes.

Those skilled in the art will recognize numerous modifications to the present invention. For example, the feedback control circuitry 22 may also include time-out circuitry that generates an interrupt signal to the inverter controller to discontinue (or minimize) voltage appearing on the transformer if Lamp1 and/or Lamp2 does not strike within a predetermined time. Additional modifications are also possible. For example, the capacitive load representing the phase-shifted low impedance network 16 depicted in FIG. 2 may be implemented with an inductive load without departing from the present invention. Also, the voltage feedback capacitor C2 could be replaced with a resistor of similar resistance characteristics without significantly changing the operational characteristics of the exemplary embodiment depicted in FIG. 2. Additionally, the resistance value of the low impedance network may be chosen to match or approximately match the resistance value of the high impedance network, however such an alteration would require the transformer to develop a higher voltage, and may require additional circuitry to ensure a desired lamp striking sequence. These and other modifications will be apparent to those skilled in the art, and all such modifications are deemed within the spirit and scope of the present invention, only as limited by the appended claims.

What is claimed is:

1. A load driving system, comprising:

a power source;

a first impedance network coupled in series to a second impedance network, said second impedance network having a different impedance value and phase-shifted with respect to said first impedance network, said first and second impedance networks coupled in parallel to said power source; and a first load coupled in series to a second load, said first and second load coupled in parallel to said first and second impedance networks, respectively; wherein said impedance difference between said first and second impedance networks generating a selected sequence of initial voltage for said first and second loads.

2. A system as claimed in claim 1, wherein said first impedance having a larger impedance value than said second impedance.

3. A system as claimed in claim 1, said first impedance comprising a resistor and second impedance comprising a capacitor, wherein said first impedance having a larger impedance value than said second impedance.

4. A system as claimed in claim 1, said first impedance comprising a resistor and second impedance comprising an inductor, wherein said first impedance having a larger impedance value than said second impedance.

5. A system as claimed in claim 1, wherein said second impedance providing a return path for said first load to said power source.

6. A system as claimed in claim 1, wherein said first load providing a return path for said second load to said power source.

7. A system as claimed in claim 1, wherein the total voltage delivered by said power source, $V_t$, satisfies the equation $V_t=\sqrt{(x^2+y^2)}$; where x is the voltage developed across said first impedance network and y is the voltage developed across the phased impedance network.

8. A system as claimed in claim 1, wherein said first load receiving a majority of initial voltage provided by said power source, thereafter said first load receiving an operational voltage less than said initial voltage.

9. A system as claimed in claim 1, wherein said second impedance being approximately 90 degrees out of phase from said first impedance.

10. A system as claimed in claim 1, further comprising voltage feedback circuitry coupled to said first and second impedances and generating a voltage feedback signal indicative of the voltage across said first and second impedances.

11. A system as claimed in claim 1, further comprising current feedback circuitry coupled to the said second lamp and generating a current feedback signal indicative of current delivered to said second load.

12. A system as claimed in claim 1, wherein said first and second loads each having a high side and a low side, said low sides coupled together and said high sides coupled to the power source.

13. A lamp driving system, comprising:

a transformer;

a first impedance network coupled in series to a second impedance network, said first impedance network having a larger impedance value than said second impedance network, said first and second impedance networks coupled in parallel to a secondary side of said transformer; and a first lamp coupled in series to a second lamp, said first and second lamps coupled in parallel to said first and second impedance networks, respectively; wherein the said larger impedance value of said first compared to second impedance networks causing said first lamp to strike before said second lamp.

14. A system as claimed in claim 13, said first impedance comprising a resistor and second impedance comprising a capacitor.

15. A system as claimed in claim 13, said first impedance comprising a resistor and second impedance comprising an inductor.

16. A system as claimed in claim 13, wherein said second impedance providing a return path for said first lamp between the top and bottom of said transformer.

17. A system as claimed in claim 13, wherein said first lamp providing a return path for said second lamp between the top and bottom of said transformer once said first lamp is struck.

18. A system as claimed in claim 13, wherein the total voltage delivered by said transformer, $V_t$, satisfies the equation $V_t=\sqrt{(x^2+y^2)}$; where x is the voltage developed across said first impedance network and y is the voltage developed across the phased impedance network.

19. A system as claimed in claim 13, wherein said first lamp receiving a majority of initial voltage provided by said transformer so that said first lamp is struck first with a lamp striking voltage, thereafter said first lamp receiving an operational voltage less than said striking voltage; said second lamp receiving a striking voltage after said first lamp is struck.

20. A system as claimed in claim 13, wherein said second impedance being approximately 90 degrees out of phase from said first impedance.

21. A system as claimed in claim 13, further comprising voltage feedback circuitry coupled to said first and second impedances and generating a voltage feedback signal indicative of the voltage across said first and second impedances.

22. A system as claimed in claim 13, further comprising current feedback circuitry coupled to the said second lamp and generating a current feedback signal indicative of current delivered to said second lamp.

23. A system as claimed in claim 13, wherein said first and second lamps each having a high side and a low side, said low sides coupled together and said high sides coupled to the top and bottom of said transformer.

24. A circuit, comprising a first impedance network coupled in series to a second impedance network, said second impedance network having a different impedance value and phase-shifted with respect to said first impedance network, said first and second impedance networks coupled in parallel to a power source; and a first load coupled in series to a second load, said first and second loads coupled in parallel to said first and second impedance networks; wherein said impedance difference between said first and second impedance networks generating a selected sequence of initial voltage for said first and second loads.

25. A circuit, comprising a first impedance network coupled in series to a second impedance network, said second impedance network having a different impedance value and phase-shifted with respect to said first impedance network, said first impedance network having a larger impedance value than said second impedance network, said first and second impedance networks coupled in parallel to a power source; and a first lamp coupled in series to a second lamp, said first and second lamps coupled in parallel to said first and second impedance networks, respectively; wherein said impedance difference between said first and second impedance networks causing said first lamp to strike before said second lamp.

26. A system as claimed in claim 1, wherein said loads selected from the group consisting of cold cathode fluorescent lamps, metal halide lamps, sodium vapor lamps and x-ray tubes.

27. A system as claimed in claim 10, said voltage feedback circuitry comprising a first impedance coupled in series with said first impedance network generating a first component voltage feedback signal indicative of voltage appearing across said first impedance network, and a second impedance coupled in series with said second impedance network generating a second component voltage feedback signal indicative of voltage appearing across said second impedance network; said first and second component voltage feedback signals being tied together at a common node and wherein the larger of said first or second component voltage feedback signals representing said voltage feedback signal.

28. A system as claimed in claim 10, wherein said voltage feedback signal being utilized to control voltage developed by said power source.

29. A system as claimed in claim 27, wherein said first impedance having a resistance value less than the resistance value of said first impedance network; said second impedance having an impedance value larger than the resistance of said second impedance network.

30. A system as claimed in claim 13, wherein said lamps selected from the group consisting of cold cathode fluorescent lamps, metal halide lamps, sodium vapor lamps, and x-ray tubes.

31. A system as claimed in claim 21, said voltage feedback circuitry comprising a first impedance coupled in series with said first impedance network generating a first component voltage feedback signal indicative of voltage appearing across said first impedance network, and a second impedance coupled in series with said second impedance network generating a second component voltage feedback signal indicative of voltage appearing across said second impedance network; said first and second component voltage feedback signals being tied together at a common node and wherein the larger of said first or second component voltage feedback signals representing said voltage feedback signal.

32. A system as claimed in claim 21, wherein said voltage feedback signal being utilized to control voltage developed by said transformer.

33. A system as claimed in claim 31, wherein said first impedance having a resistance value less than the resistance value of said first impedance network; said second impedance having a resistance value larger than the resistance of said second impedance network.

34. A system as claimed in claim 1, wherein said power source comprises a transformer.

* * * * *